United States Patent [19]

Pierson, Sr. et al.

[11] 4,040,597

[45] Aug. 9, 1977

[54] CORE HOLDING STRUCTURE FOR MOLDS

[75] Inventors: Fred W. Pierson, Sr., Grand Rapids; Fred W. Pierson, Jr., Wyoming; Gordon J. Weidenfeller, Grandville, all of Mich.

[73] Assignee: M&T Mfg. Co., Grand Rapids, Mich.

[21] Appl. No.: 599,145

[22] Filed: July 25, 1975

[51] Int. Cl.[2] ..... B22C 9/24; B28B 7/32

[52] U.S. Cl. ..... 249/134; 249/149; 249/146; 249/177

[58] Field of Search ..... 425/175, 180; 249/134, 249/175, 177, 135, 136, 139, 142, 124, 143–148, 83, 90, 94–96

[56] References Cited

U.S. PATENT DOCUMENTS

| | | | |
|---|---|---|---|
| 763,333 | 6/1904 | Stevens | 249/146 |
| 1,727,343 | 9/1929 | Guyot | 249/142 X |
| 2,299,710 | 10/1942 | Dray | 249/144 X |
| 3,058,156 | 10/1962 | O'Connor | 249/142 X |
| 3,285,835 | 11/1966 | Farrow | 425/175 X |
| 3,355,772 | 12/1967 | Kolberg | 249/96 X |
| 3,576,050 | 4/1971 | Thomas | 249/177 X |
| 3,773,875 | 11/1973 | Lammers | 249/83 X |

*Primary Examiner*—Francis S. Husar
*Assistant Examiner*—John S. Brown
*Attorney, Agent, or Firm*—Low & Matthews

[57] ABSTRACT

A core holding structure for molds and method of making same. A hollow bushing is locked within a mold so positioned with respect to a cavity in the mold that a rod-like core may be mounted on the bushing to provide a bore for hollow members such as spouts used in the continuous casting of metals. The bushing effects proper spacing of the core from the walls of the mold so that the wall thickness of the finished article is controlled. The mold may be made from a single member or it may be made from a multiple piece mold. Special knock out plate members are used in connection with the one-piece molds to extend the life thereof.

6 Claims, 7 Drawing Figures

CORE HOLDING STRUCTURE FOR MOLDS

This invention relates to mold structures and methods of making same and, more particularly, to mold structures for molding hollow articles with unique core holding devices within the molds and methods of making same.

Heretofore it has been the practice to utilize a plurality of wooden spacer members to locate a core member within the cavity of a mold for making hollow products. These spacer members must be carefully placed in order to produce a satisfactory hollow product, such as pouring spouts, and require a substantial amount of time in the molding operation.

It has been found that the wooden spacer members may be completely eliminated by the practice of the present invention and that substantial savings of set up time may be achieved by utilizing the core holding structure for molds of the present invention. In addition to being quicker, the molds of this invention are more economical and result in less spoilage of molded parts.

In accordance with the present invention, a method of supporting a core within an opening of a mold member is disclosed wherein a bushing member is locked within a mold with the bushing member having a bore therein in communication with the opening of the mold member and in a predetermined alignment therewith. The aforementioned alignment permits a pin means to be inserted within the bore of the bushing member and a rod-like core member mounted on the pin means to produce hollow molded members of substantially uniform or controlled wall thicknesses.

In the method of making a mold with the core supporting structure of the present invention locked therein, the procedure comprises placing a metallic frame member on a support surface and locating a pattern core within the frame member. A hollow bushing member is positioned atop the pattern core and removably or separably attached thereto. The mold material is poured within the frame member and around both the pattern core and the hollow bushing member after which the pattern core is removed from the mold.

The inherent advantages and improvements of the present invention will become more readily apparent upon considering the following detailed description of the invention and by reference to the drawings in which.

Figure 1:
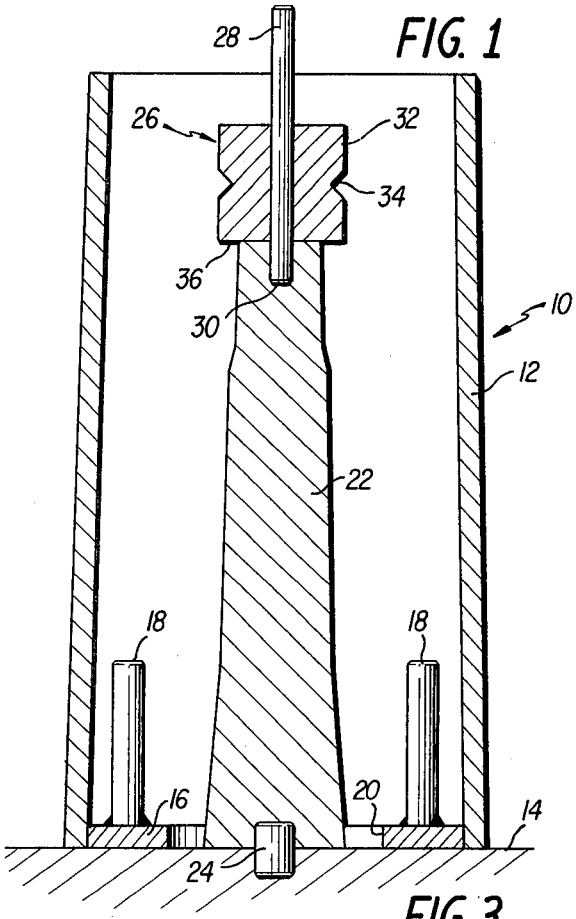
FIG. 1 is an elevational view taken in vertical cross section illustrating one step in the method of making a mold in accordance with the present invention.
Figure 5:
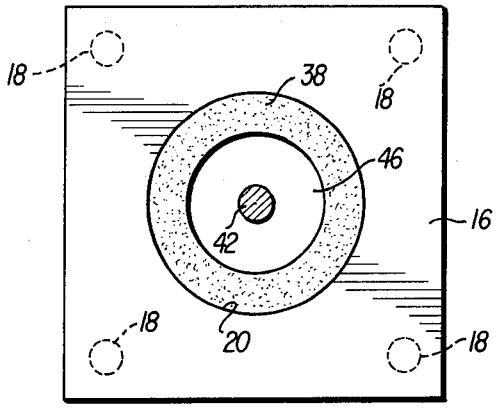
FIG. 5 is a top plan view of the mold of FIG. 4 as viewed along line 5—5 thereof.

Referring now to FIG. 1 of the drawings, there is illustrated a mold making assembly indicated generally at 10 having a rectangular metallic frame member 12 mounted on a work surface 14, such as a table top. A striker plate 16, seen in plan view in FIG. 5, is placed on the work surface 14 within the rectangular metallic frame member 12. The striker plate 16 has a series of four legs 18 welded thereto adjacent the corners thereof so as to anchor the striker plate within the material of the mold when it is poured.

As is also seen in FIGS. 1 and 5, the striker plate 16 has a circular cutout portion 20 within which a pattern core for a spout or the like is positioned centrally thereof with the aid of a locator pin 24 in the work surface 14. Further fixture elements, not shown, make it possible to center or register the metallic frame member 12 with respect to the pattern core 22, located on work surface 14.

A hollow bushing member 26, preferably made from aluminum rod, is positioned atop the pattern core 22 and is removably attached thereto by means of a pin 28. The latter extends above the top of the frame member 12 and also extends into a reamed countersunk hole 30 in pattern core 22 to accommodate the pin 28. Hollow bushing member 26 has a cylindrical wall 32 which is provided with an inwardly extending groove 34 which in effect constitutes a peripheral notch in the bushing 26 in order to lock the bushing within the mold as will be described hereinafter. It is convenient to make the sides of the notch form an included angle of 90° although the angle is not critical. Surface 36 of bushing 26 is disposed in contact with the top of pattern core 22.

Figure 2:
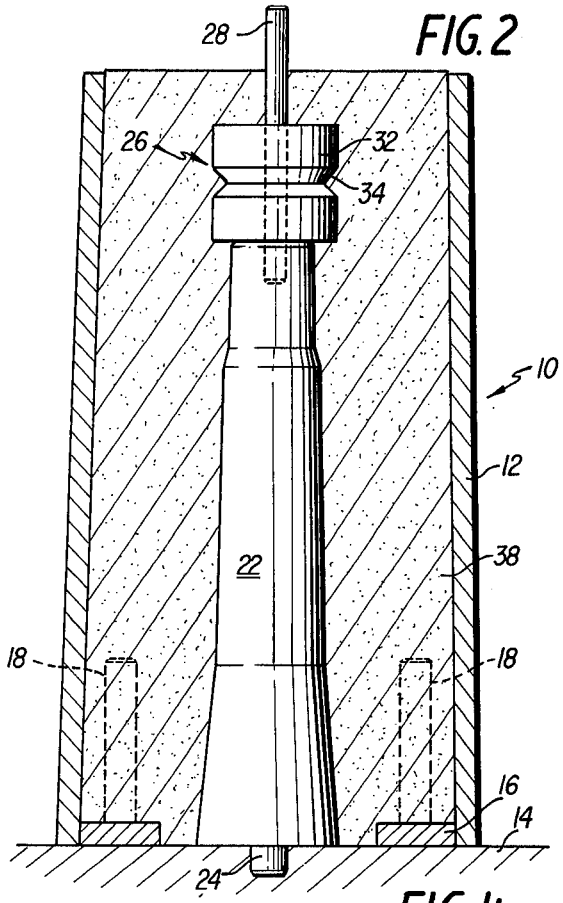
FIG. 2 is an elevational view taken in vertical cross section illustrating a step subsequent to that shown in FIG. 1.
Figure 3:
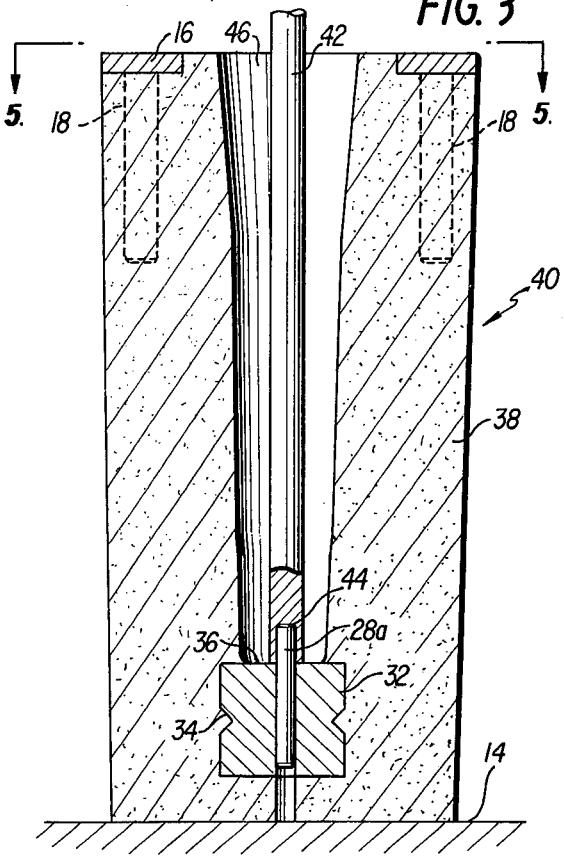
FIG. 3 is an elevational view taken in vertical cross section of the mold produced in FIG. 2 illustrating a step in the production of a hollow spout member.

Referring now to FIG. 2, a pottery plaster mold material 38 has been poured into the rectangular metallic frame member 12 to the top thereof so as to form a one-piece mold in accordance with the present invention. The one-piece mold itself is designated generally at 40 in FIG. 3 which has been obtained from the FIG. 2 arrangement by removing pin 28 and then removing the mold 40, reversing it and placing it again on work surface 14 in FIG. 3. The metallic frame member 12 has a continuous taper from one end to the other. For example, a typical mold produced therefrom as shown in FIG. 3 will have a 4½ inches square base resting on work surface 14 and a 5 inches square at the end which receives striker plate 16. The bushing 26 has been providedwith a shorter pin **28*a* which extends above the surface 36 of bushing 26 and is press fitted into a countersunk hole 44 in a rod-like core 42. This construction centers or registers the rod-like core 42 with respect to opening 46 in the mold which was provided for by the pattern core or spout pattern 22 of FIGS. 1 and 2**.

Figure 4:
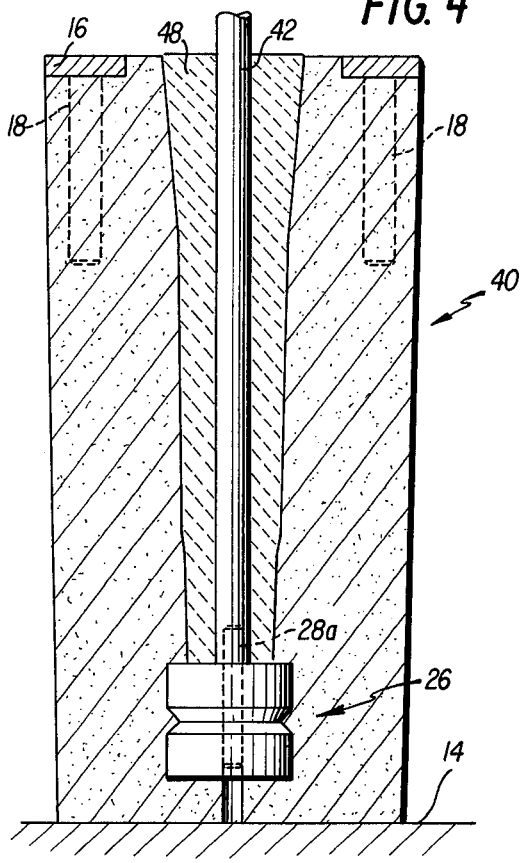
FIG. 4 is an elevational view taken in vertical cross section similar to that shown in FIG. 3 but showing the molded hollow spout within the mold.
Figure 7:
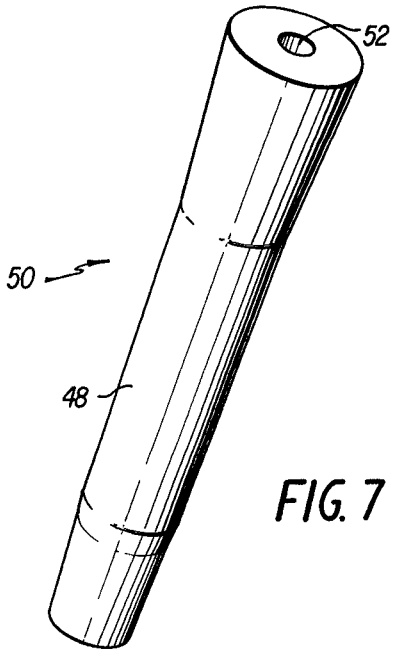
FIG. 7 is a perspective view of a hollow pouring spout as produced in either the mold of FIG. 4 or the mold of FIG. 6.

A hollow article such as a spout is then produced as is depicted in FIG. 4 by pouring in a dense silica material 48. The spout which is produced is indicated generally at 50 in FIG. 7 by removing the rod-like core 42 and rapping or pounding the one-piece mold 40 on the striker plate 16 which is seen in plan view in FIG. 5. The spout 50 is shown to have a central bore 52 which is provided by core 42 of FIG. 4. The spacing of the core 42 from the sides of the opening 46 in mold 40 determines the thickness of the walls of spout 50.

Figure 6:
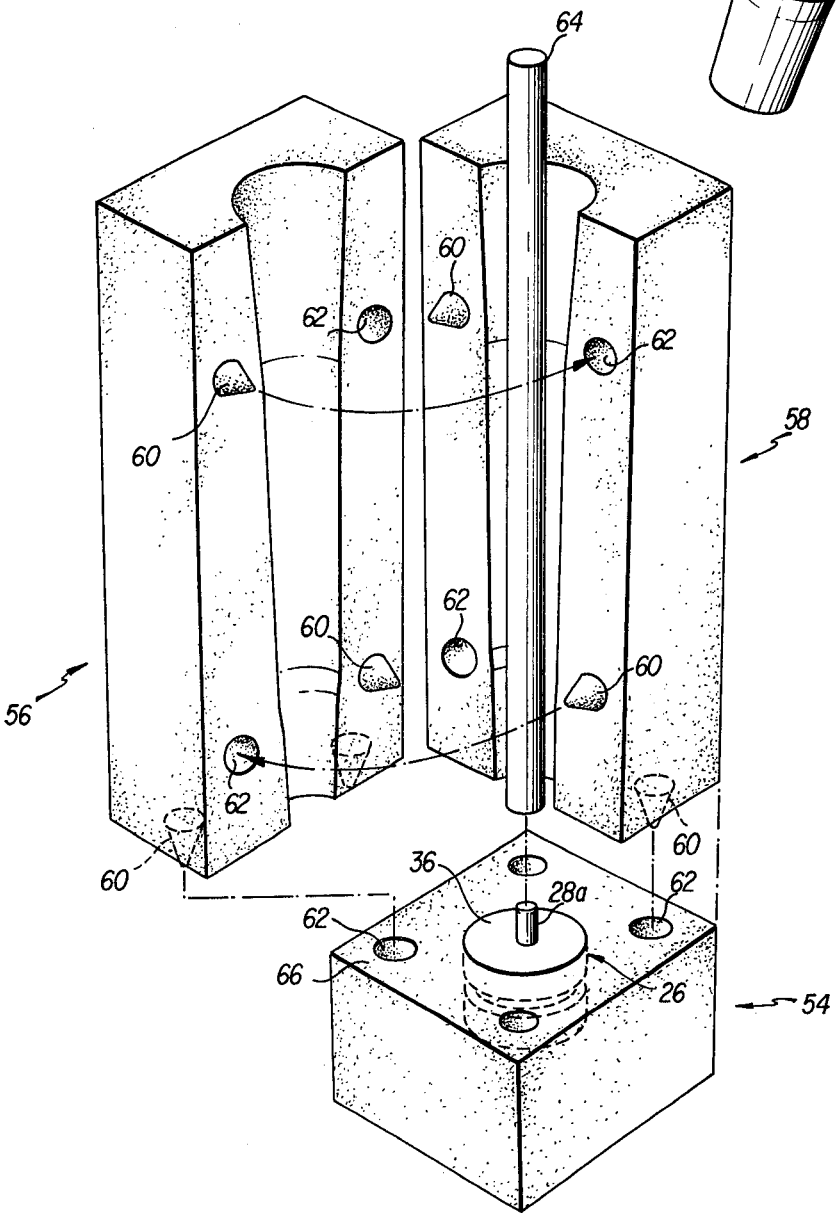
FIG. 6 is an exploded perspective view of another embodiment of a mold made in accordance with the present invention.

A modified form of the mold construction is shown in FIG. 6. Reference to that figure reveals a three-piece mold which includes a base indicated generally at 54 and split mold sections indicated generally at 56 and 58. The split mold sections 56 and 58 are each provided with suitable locator buttons 60 and mating holes therefor 62 and similar locating buttons 60 and holes 62 are provided between the split mold sections themselves and base 54. The locator buttons 60 are shown to be conical in shape, as are the holes 62, but the buttons and holes are conventional and may be of any suitable shape and arrangement. A hollow bushing member 26 similar to that shown in FIGS. 1 through 4 is locked within the base 54 by the method described previously so that the surface 36 of bushing 26 is flush with the top surface 66 of base 54. Similarly, a rod-like core 64 is mounted on a pin 28*a* which extends upwardly above the surface 36 of hollow bushing member 26. Rod-like core 64 is substantially identical to core 42 illustrated in FIGS. 3 and 4 for purposes of spacing the rod-like core 64 centrally of the apertures provided in the split mold sections 56 and 58.

As a specific example of a mold structure made in accordance with the present invention, but without limitation, a mold assembly 10 was arranged as shown in FIG. 1. The bushing member 26 was made from 1⅝ inches diameter aluminum rod with its bore reamed to accommodate a ¼ inch rod in a slip fit. The shell 12 was made from ¼ inch steel. Hole 44 was reamed to accommodate a ¼ inch diameter cold rolled steel rod for a press fit. Rod 42 was a 7/16 inch cold rolled steel. Striker plate 16 was formed from ¼ inch hot rolled steel plate to which was welded four ⅜ inch diameter rods 18. Mold 40 was 10 inches high with a square tapering body from a 4½ inch square resting on a table top 14 to a 5 inch square at its top as viewed in FIG. 3. A 3 inch diameter cutout 20 was provided in the ¼ inch plate 16 by being flame cut. A mold made according to these dimensions produced more than 20 spouts and required no wooden locator members for core 42.

Bushing 26 is suitable for use in making molds whether they be a one-piece construction or a movable section mold such as is illustrated in FIG. 6. When the single piece mold is utilized, the striker plate 16 permits greatly extended use of the mold without breaking. Thus in excess of 20 casts have been provided utilizing the single piece mold equipped with striker plate 16. The method of molding disclosed herein is much quicker than that which was used previously with the production having doubled on a daily basis. Furthermore, the molds are economical in that in excess of 20 casts have been made per mold with substantially less spoilage of parts.

While presently preferred embodiments of the invention have been illustrated and described, it will be recognized that the invention may be otherwise variously embodied and practiced within the scope of the claims which follow.

We claim:

1. A plaster mold structure for molding hollow articles which comprises a. a one piece plaster mold having an elongated cavity therein, b. a bushing member permanently locked within said one piece plaster mold having a longitudinal bore contiguous with and in substantial alignment with the longitudinal axis of said elongated cavity, c. pin means received within said bore of said bushing and extending above the upper surface of said bushing member and partially into said cavity, and d. a rod-like core member mounted on said pin means of said bushing member with said pin means and a portion of the upper surface of said bushing member providing the sole support for said rod-like core member, 1. said rod-like core member adapted to provide a core for a hollow article molded within said cavity and extending partially out of said mold.

2. A plaster mold structure for molding hollow articles as defined in claim 1 including metallic striker plate means secure at the top of said mold substantially adjacent to the cavity in said mold to facilitate removal of a hollow article from said mold.

3. A plaster mold structure for molding hollow articles as defined in claim 2 wherein said striker plate means is secured to the top of said mold by a plurality of leg members secured to said striker plate means and extending into said mold.

4. A plaster mold structure for molding hollow articles as defined in claim 1 including means to interlock said bushing member to said mold.

5. A plaster mold structure for molding hollow articles as defined in claim 4 wherein said means to interlock said bushing member to said mold includes a peripherally inwardly extending groove in said bushing member.

6. A plaster mold structure for molding hollow articles which comprises:

a. a three piece plaster mold consisting of two substantially half mold sections each supported on a block-like base section, b. said two substantially half mold sections defining an elongated cavity extending therebetween when assembled, c. a bushing member permanently locked within said block-like base section having an upper surface substantially flush with the upper surface of said block-like base section, d. said bushing member further having a longitudinal bore contiguous with and in substantial alignment with the longitudinal axis of the elongated cavity extending through said substantially half mold sections, e. pin means received within said bore of said bushing and extending partially into said cavity, and f. a rod-like core member mounted on said pin means of said bushing member, 1. said rod-like core member adapted to provide a core for a hollow article molded within said cavity and extending partially out of said mold.

* * * * *